US012514382B2

(12) United States Patent
Nottage

(10) Patent No.: US 12,514,382 B2
(45) Date of Patent: Jan. 6, 2026

(54) SYSTEMS AND APPARATUSES FOR AN INFANT SWING

(71) Applicant: GRACO CHILDREN'S PRODUCTS, INC., Atlanta, GA (US)

(72) Inventor: Ryan W. Nottage, Kennesaw, GA (US)

(73) Assignee: GRACO CHILDREN'S PRODUCTS, INC., Atlanta, GA (US)

( * ) Notice: Subject to any disclaimer, the term of this patent is extended or adjusted under 35 U.S.C. 154(b) by 421 days.

(21) Appl. No.: 18/326,827

(22) Filed: May 31, 2023

(65) Prior Publication Data

US 2023/0404290 A1 Dec. 21, 2023

Related U.S. Application Data

(60) Provisional application No. 63/366,564, filed on Jun. 17, 2022.

(51) Int. Cl.
*A47D 13/10* (2006.01)

(52) U.S. Cl.
CPC ..... *A47D 13/105* (2013.01)

(58) Field of Classification Search
CPC ..... A47D 13/105; A47D 13/107
See application file for complete search history.

(56) References Cited

U.S. PATENT DOCUMENTS 7,563,170 B2 7/2009 Bellows et al.
8,834,282 B2 9/2014 Sclare et al.
9,033,809 B2 5/2015 Haut et al.
2007/0111809 A1* 5/2007 Bellows ..... A47D 13/105 472/118
2008/0217974 A1* 9/2008 Velderman ..... A47D 13/107 297/256.16
2008/0238163 A1* 10/2008 Bellows ..... A47D 9/057 297/274
2013/0184088 A1* 7/2013 Haut ..... A47D 9/016 472/119
2013/0244803 A1* 9/2013 Haut ..... A47D 13/105 472/119
2014/0018179 A1* 1/2014 Mountz ..... A47D 9/016 472/119
2017/0273474 A1* 9/2017 Ziv ..... A47D 13/107

* cited by examiner

*Primary Examiner* — Alexander K Garlen
(74) *Attorney, Agent, or Firm* — Eversheds Sutherland (US) LLP

(57) ABSTRACT

An infant swing system may include a base structure, a vertical support coupled to the base structure, a frame that includes a wire portion coupled to the vertical support, and a seat removably coupled to the frame. A bouncer may be disposed in the vertical support. The bouncer is configured to cause the seat to bounce in a vertical direction to simulate a parent bouncing the child. A rotator may be disposed in the vertical support. The rotator is configured to cause the seat to move in a lateral direction to simulate a parent swaying the child. A tapper component may be coupled to the rear side of the seat. The tapper component may include a spring, a weighted head coupled to the spring, and a motor. The tapper component is configured to tap the rear side of the seat to simulate a parent tapping the child on the back.

20 Claims, 3 Drawing Sheets

SYSTEMS AND APPARATUSES FOR AN INFANT SWING

CROSS-REFERENCE TO RELATED APPLICATION

This application claims the benefit of U.S. Application Ser. No. 63/366,564, filed Jun. 17, 2022, the entirety of which is hereby incorporated by reference.

TECHNICAL FIELD

The present disclosure is generally directed to children's products, and more particularly to systems and apparatuses for providing an infant swing.

BACKGROUND

Certain infant swings are well-known in the art. At times, infants, toddlers, and children can be fussy and difficult to soothe. Often, a parent can try to calm an infant such as swaying, bouncing, and tapping in order to soothe his or her infant. In some instances, a conventional infant swing can be used to assist a parent in soothing his or her infant. Typically, the conventional infant swing can provide a structure for the infant to be contained while the parent manipulates the infant swing in order to soothe the infant.

However, such conventional infant swings may not be preferred by parents because conventional infant swings may require mechanical operation by a user and/or may require manual inputs in order for the infant swing to begin movement.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

Figure 1:
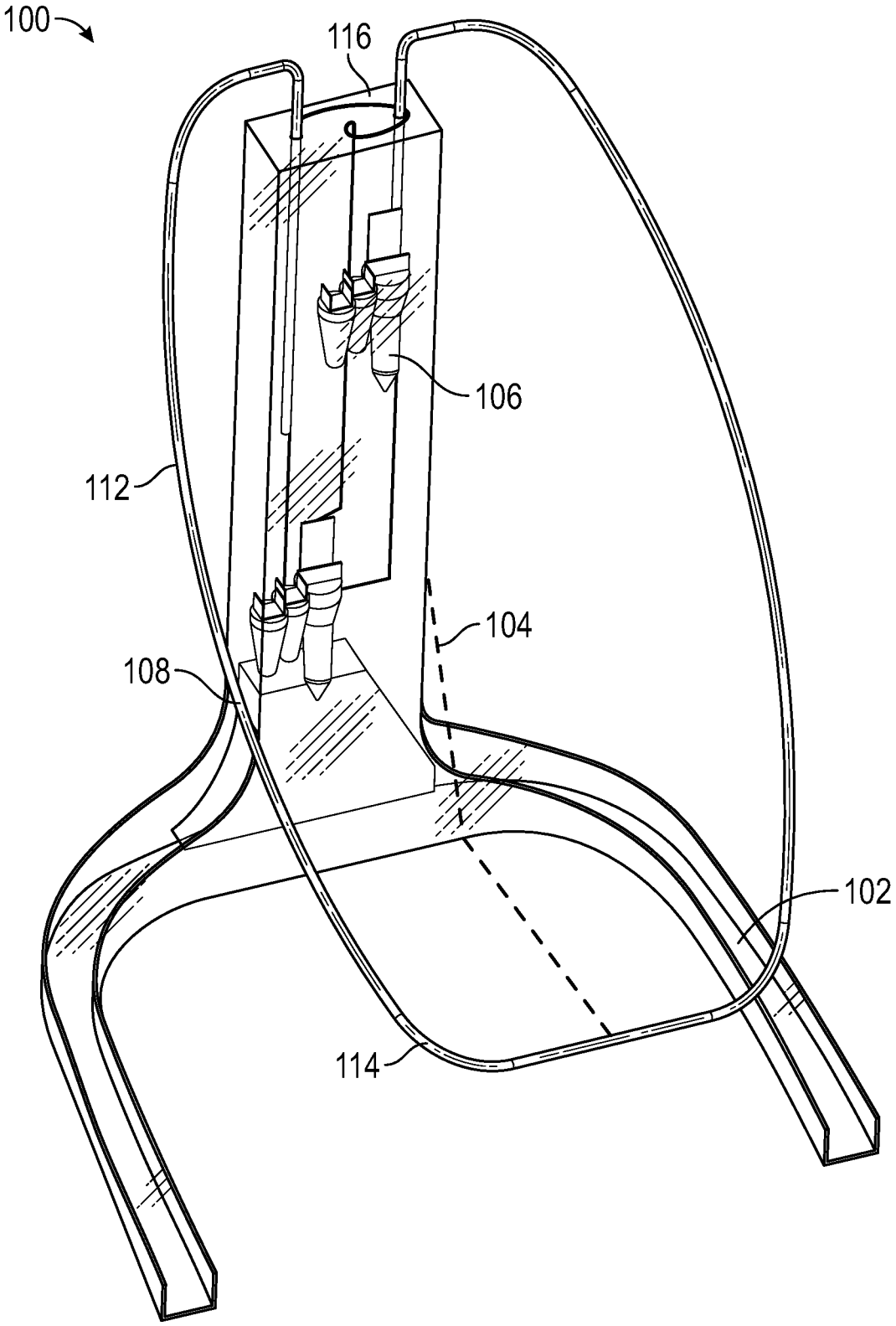
FIG. 1 is an illustrative diagram of an internal structure of an infant swing in accordance with one example embodiment of the disclosure.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure.

DETAILED DESCRIPTION OF THE EXAMPLE EMBODIMENTS

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical elements throughout.

Certain relationships between features of the infant swing are described herein using the term "substantially" or "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variation that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom.

This disclosure relates to, among other things, systems and apparatuses for an infant swing. In one embodiment, a system and apparatus for an infant swing can be provided.

In one example embodiment, a system and apparatus for an infant swing can include a base structure, a vertical support having a bouncing mechanism and a swaying mechanism, a frame, a wire portion, and a seat portion having a tapping mechanism attached to a seat back of the seat portion.

In one embodiment, the bouncing mechanism may be configured to enable the seat portion to move upwards and downwards, thus simulating a parent bouncing a child.

In one embodiment, the swaying mechanism may be configured to enable the seat portion to rotate about the vertical support, thus simulating a parent swaying while holding a child.

In one embodiment, the tapping mechanism may be configured to enable tapping motions on the seat back, thus simulating a parent tapping a child on the back.

Turning to the figures, FIG. 1 depicts an illustrative diagram of an infant swing 100 in accordance with one example embodiment of the disclosure. As shown in FIG. 1, the infant swing 100 can include a base structure 102. In some embodiments, the base structure 102 may be an oval shape, a rectangular shape with rounded or non-rounded edges, or any other shape. In some embodiments, the base structure 102 may be made of a rigid material in order to provide support to the infant swing 100.

Figure 2:
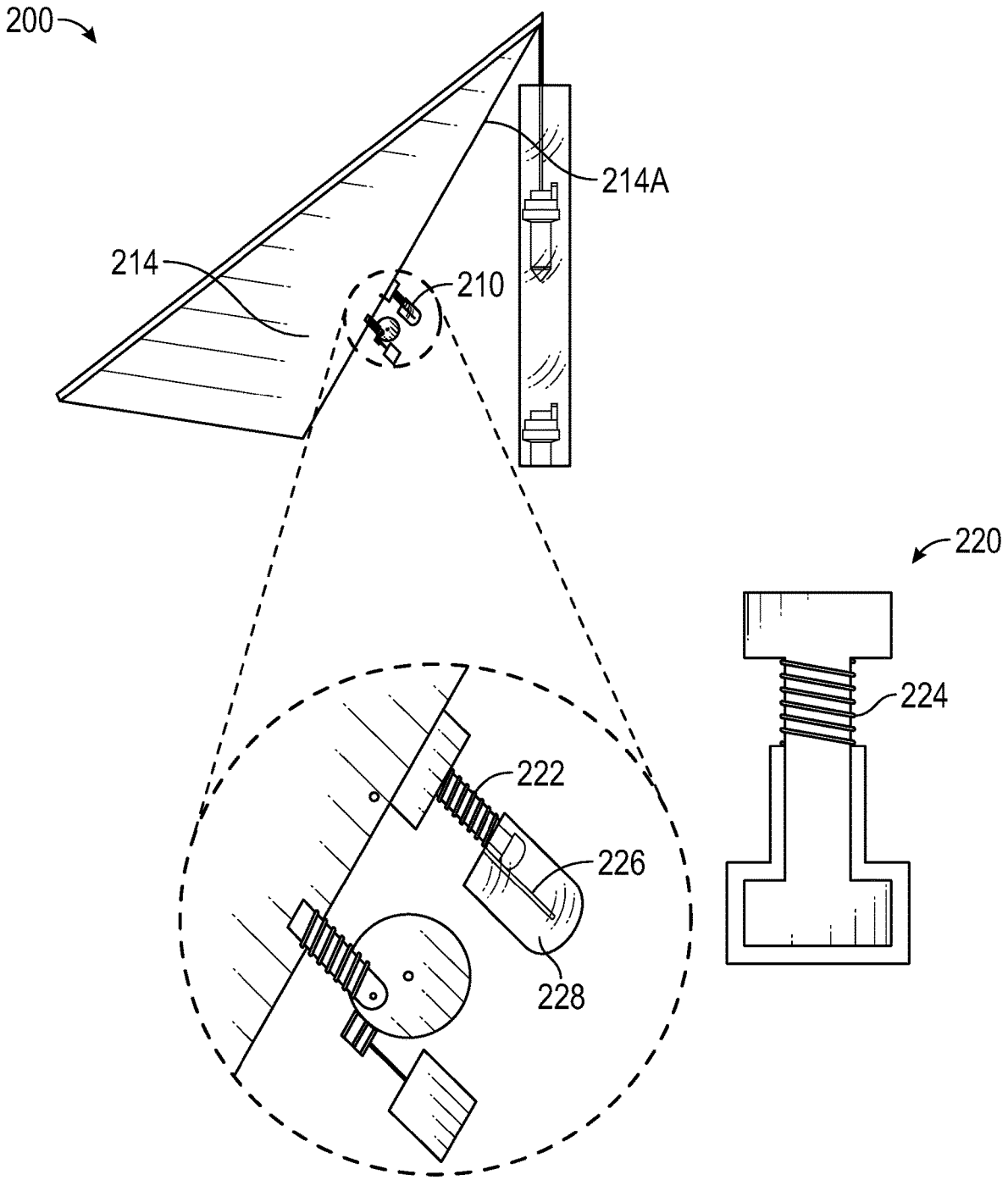
FIG. 2 is an illustrative diagram of an internal structure of an infant swing in accordance with one example embodiment of the disclosure.

As shown in FIG. 1, the infant swing 100 can further include a vertical support 104 coupled to the base structure 102. In some embodiments, the vertical support 104 may include a bouncing mechanism 106 or bouncer component, and/or a swaying mechanism 108 or rotator component. In some embodiments, as shown in FIG. 2, a frame 114 may be connected to a tapping mechanism or tapper, as discussed herein. In some embodiments, the frame 114 may include a wire portion 112 that forms an outline configured to receive the seat 214. The wire portion 112 and/or frame 114 of the infant swing 100 may be coupled to the vertical support 104 in a cantilevered arrangement. The seat 214 may then be removably coupled to the wire portion 112. In some embodiments, the wire portion 112 of the infant swing 100 may be formed in an oval shape, a rectangular shape with rounded or non-rounded edges, or any other shape that is configured to support the seat 214 of the infant swing 100. In some embodiments, a first end segment and a second end segment of the wire portion 112 are connected to an upper end of the vertical support 104 in a parallel configuration. In some embodiments, a string or other connective mechanism 116 may connect the first end segment and the second end segment of the wire portion 112 in order to pull the first end segment and the second end segment of the wire portion 112 to each other. The first end segment and the second end segment of the wire portion 112 may extend through the vertical support 104. In some embodiments, the first end segment of the wire portion 112 extends further into the vertical support 104 than the second end segment of the wire portion 112.

The swaying mechanism 108 may further include processing circuitry and components that are configured to enable a swaying motion about the vertical support 104. The first end segment and the second end segment of the wire portion 112 may be connected to a transmission device within the swaying mechanism 108, and both ends of the wire portion 112 may be configured to be able to rotate freely. In some embodiments, when the transmission device rotates in a first direction, the wire portion 112 is rotated, thus causing a deflection in the wire portion 112. When the transmission device is rotated in a second direction that is opposite the first direction, the wire portion 112 is de-rotated, thus causing the wire portion 112 to return to its original shape. Thus, when the swaying mechanism 108 is activated, the wire portion 112 is configured to rotate or de-rotate. When the seat 214 is removably coupled to the infant swing 100 and a child is contained within the seat 214, the activation of the swaying mechanism 108 causes the wire portion 112 to rotate. The rotation of the wire portion 112 causes the frame 114 to move in one or more lateral directions, thereby causing the seat 214 to move in the one or more lateral directions, thus simulating a parent swaying while holding a child.

The bouncing mechanism 106 may further include processing circuitry and components that are configured to enable a bouncing motion about the vertical support 104. In some embodiments, the frame 114 is cantilevered from the vertical support 104 where the first end segment and the second end segment of the wire portion 112 are located. Thus, when the bouncing mechanism 106 is activated, the bouncing mechanism 106 provides a force on the first end segment and the second end segment of the wire portion 112, which causes the frame 114 to bounce in a vertical direction. It should be noted that the amount of movement of the seat 214 is amplified from the amount of force applied to the wire portion 112 due to the cantilevered nature of the frame 114. When the seat 214 is removably coupled to the infant swing 100 and a child is contained within the seat 214, the activation of the bouncing mechanism 106 causes movement of the frame 114, thus simulating a parent bouncing the child.

Although not depicted in FIG. 1, in some embodiments, one or more electromagnets may be used to create the force applied on the wire portion 112. In other embodiments, a string or other connective mechanism that is connected to a transmission device or a cam feature that is connected to a transmission may be used to create the force applied on the wire portion 112.

In some embodiments, the infant swing 100 may be configured to provide positional feedback and/or frequency feedback. Positional feedback enables the infant swing 100 to reverse the transmission device if necessary to ensure motion within a predefined range, and frequency feedback enables the infant swing 100 to maintain a natural frequency similar to a parent soothing a child.

FIG. 2 depicts an illustrative diagram of an infant swing 200 in accordance with one example embodiment of the disclosure. More specifically, FIG. 2 depicts a tapping mechanism 210 of the infant swing 200. In some embodiments, the tapping mechanism 210 is disposed along a seat back 214A of a seat portion 214 of the infant swing 200.

In some embodiments, the tapping mechanism 210 can include a tapper component 220. In some embodiments, the tapper component 220 may include a spring 224, a weighted head 222 coupled to the spring 224, a ramping channel 226, and a return channel 228. The tapper component 220 may be configured to automate a tapping motion for the tapping mechanism 210 by using a motor to compress the spring 224. In some embodiments, the spring 224 may have an adjustable tension. In other embodiments, the spring 224 can be replaced with a trigger, a pen, or another similar mechanism. In some embodiments, when the spring 224 is being compressed, a ramping feature, or in some embodiments a motor, drives the weighted head 222 from the ramping channel 226 to the return channel 228. At this point, the spring 224 may be fully loaded, and the return channel 228 allows the body 222 and the spring 224 to travel back to its original position. When the seat portion 214 is removably coupled to the infant swing 200 and a child is contained within the seat portion 214, the weighted head 222 and the spring 224 return back to their original position while adding pressure on a pad having a soft side that is attached to the seat back 214A, thus acting on the seat back 214A, and thus simulating a parent tapping a child on the back.

Figure 3:
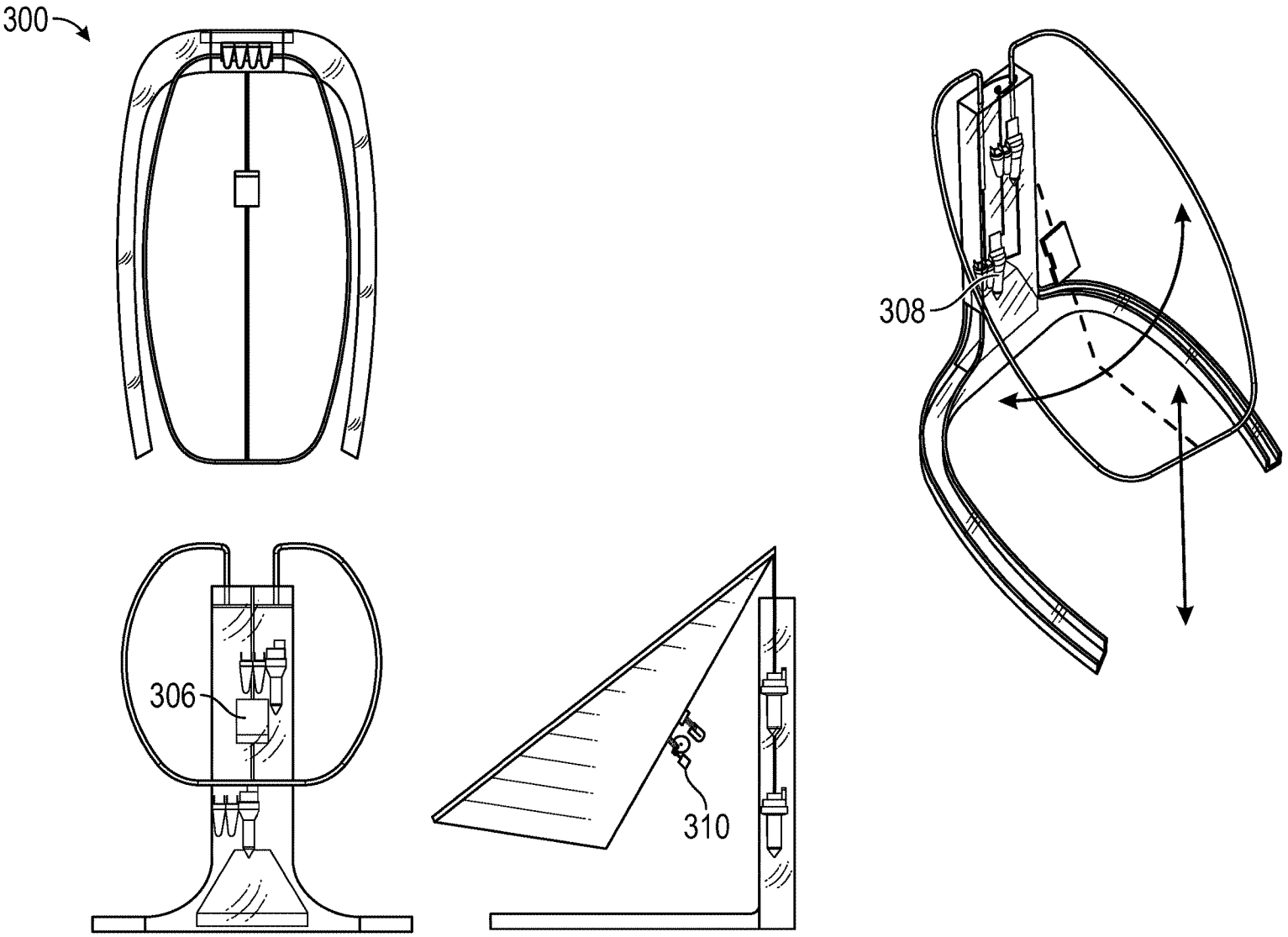
FIG. 3 is an illustrative diagram of an internal structure of an infant swing in accordance with one example embodiment of the disclosure.

FIG. 3 depicts an illustrative diagram of an infant swing 300 in accordance with one example embodiment of the disclosure. More specifically, FIG. 3 illustrates the relative positions of the tapping mechanism 310, the bouncing mechanism 306, and the swaying mechanism 308 of the infant swing 300.

Although not depicted in FIGS. 1-3, in some embodiments, the bouncing mechanism 106, the swaying mechanism 108, and the tapping mechanism 110 may be configured to operate individually, or simultaneously in any combination, to soothe a child.

Although not depicted in FIGS. 1-3, the infant swing 100 can be configured to include technology capable of detecting a child crying, such that the infant swing 100 may modify actions taken by the bouncing mechanism 106, the swaying mechanism 108, and the tapping mechanism 110 if the child is detected to be crying.

Though the disclosed examples include particular arrangements of a number of parts, components, features, and aspects, the disclosure is not limited to only those examples or arrangements shown. Any one or more of the parts, components, features, and aspects of the disclosure can be employed alone or in other arrangements of any two or more of the same.

Although certain product features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Unless otherwise noted, the terms used herein are to be understood according to conventional usage by those of ordinary skill in the relevant art. In addition to the definitions of terms provided below, it is to be understood that as used in the specification and in the claims, "a" or "an" can mean one or more, depending upon the context in which it is used.

Throughout this application, the term "include," "include (s)" or "including" means "including but not limited to." Note that certain embodiments may be described relating to a single glass, but the corresponding description should be read to include embodiments of two or more glasses. Different features, variations, and multiple different embodiments are shown and described herein with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

What has been described herein in the present specification and annexed drawings includes examples of systems, apparatuses, devices, and techniques that, individually and in combination, provide for an infant swing. It is, of course, not possible to describe every conceivable combination of components and/or methods for purposes of describing the various elements of the disclosure, but it can be recognized that many further combinations and permutations of the disclosed elements are possible. Accordingly, it may be apparent that various modifications can be made to the disclosure without departing from the scope thereof. In addition, or as an alternative, other embodiments of the disclosure may be apparent from consideration of the specification and annexed drawings, and practice of the disclosure as presented herein. It is intended that the examples put forth in the specification and annexed drawings be considered, in all respects, as illustrative and not limiting. Although specific terms are employed herein, they are used in a generic and descriptive sense only and not for purposes of limitation.

The invention claimed is:

1. An infant swing system comprising:
a base structure;
a vertical support coupled to the base structure;
a frame comprising a wire portion, wherein the wire portion is coupled vertically to the vertical support in a cantilevered arrangement;
a seat removably coupled to the frame;
a bouncer component disposed in the vertical support, the bouncer component configured to cause the seat to bounce in a vertical direction; and
a rotator component disposed in the vertical support, the rotator component configured to cause the seat to move in a lateral direction.

2. The infant swing system of claim 1, wherein the bouncer component causes a force to be applied on a first end segment and a second end segment of the wire portion, wherein the first end segment and the second end segment are coupled to an upper end of the vertical support in a parallel configuration.

3. The infant swing system of claim 1, wherein the first end segment extends further into the vertical support than the second end segment.

4. The infant swing system of claim 1, further comprising:
a tapper component coupled to the seat, the tapper component configured to tap a rear side of the seat, wherein the tapper component comprises:
a spring;
a weighted head coupled to the spring; and
a motor configured to compress the spring;
wherein the weighted head imparts a tapping motion to the rear side of the seat when the spring is decompressed.

5. The infant swing system of claim 4, wherein the spring comprises an adjustable tension.

6. The infant swing system of claim 4, wherein the tapper component is configured to modify pressure on the rear side of the seat.

7. The infant swing system of claim 1, wherein switching on the bouncer component causes a force to be applied on the wire portion.

8. The infant swing system of claim 1, wherein the rotator component is configured for rotating the seat about the vertical support.

9. The infant swing system of claim 8, wherein switching on the rotator component causes the wire to rotate.

10. An apparatus, comprising:
a base structure;
a vertical support, comprising:
a bouncer configured for moving a seat upwards or downwards; and
a rotator configured for rotating the seat about the vertical support;
a wire comprising a wire portion coupled vertically to the vertical support in a cantilevered arrangement, the seat coupled to the wire; and
a tapper coupled to a seat back of the seat.

11. The apparatus of claim 10, wherein the seat is removably coupled to the wire.

12. The apparatus of claim 10, wherein switching on the bouncer causes a force to be applied on the wire.

13. The apparatus of claim 10, wherein switching on the rotator causes the wire to rotate.

14. The apparatus of claim 10, wherein the tapper is configured for adding or reducing pressure on a portion of the seat back.

15. An infant swing system, comprising:
a base structure;
a vertical support comprising a bouncer and a rotator;
a wire comprising a wire portion coupled vertically to the vertical support in a cantilevered arrangement; and
a seat removably coupled to the wire, wherein a tapper is coupled to a seat back of the seat.

16. The system of claim 15, wherein the bouncer is configured for moving the seat upwards or downwards.

17. The system of claim 16, wherein switching on the bouncer causes a force to be applied on the wire.

18. The system of claim 15, wherein the rotator is configured for rotating the seat about the vertical support.

19. The system of claim 18, wherein switching on the rotator causes the wire to rotate.

20. The system of claim 15, wherein the tapper is configured for adding or reducing pressure on a portion of the seat back.

* * * * *